United States Patent [19]

Mooradian

[11] 3,941,387

[45] Mar. 2, 1976

[54] RACE GAME APPARATUS

[76] Inventor: Anthony Mooradian, 10825 Silicon Ave., Pomona, Calif. 91766

[22] Filed: Dec. 13, 1974

[21] Appl. No.: 532,413

[52] U.S. Cl. .. 273/134 B; 273/118 R; 273/134 CH; 273/138 R

[51] Int. Cl.[2] ..... A63F 3/00

[58] Field of Search..... 273/118, 134, 138

[56] References Cited

UNITED STATES PATENTS

| | | | |
|---|---|---|---|
| 973,484 | 10/1910 | Dorsey | 273/118 R |
| 1,213,718 | 1/1917 | Wetherill | 273/134 B |
| 2,199,016 | 4/1940 | Watkins | 273/134 B X |
| 2,791,431 | 5/1957 | Scaroulis | 273/134 B |
| 3,416,802 | 12/1968 | Montes | 273/134 CH UX |

*Primary Examiner*—Delbert B. Lowe
*Attorney, Agent, or Firm*—John H. Crowe

[57] ABSTRACT

The game includes a replica of a race course which is divided into a sequence of stations and the players take turns to advance distinctively colored markers or playing pieces along the race course. To determine the number of stations through which a player in his turn advances his marker, the player manually imparts impetus to a metal ball which causes the ball to traverse a straight track that has resilient bumpers at its two opposite ends. The ball recoils from at least one of the bumpers and comes to rest at one of a plurality of sections of the track which indicate the number of stations the player is to advance his marker on the course.

5 Claims, 3 Drawing Figures

FIG. 1.
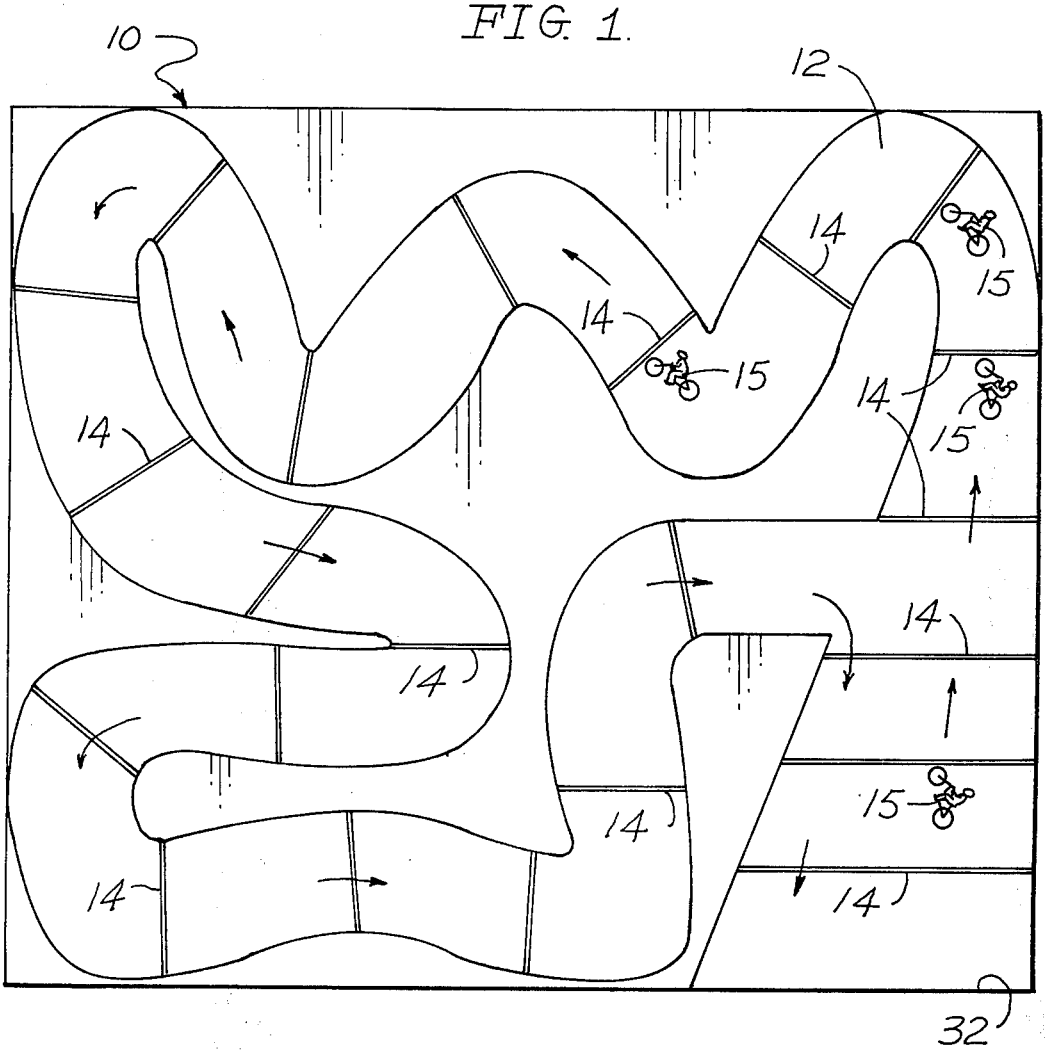
FIG. 2.
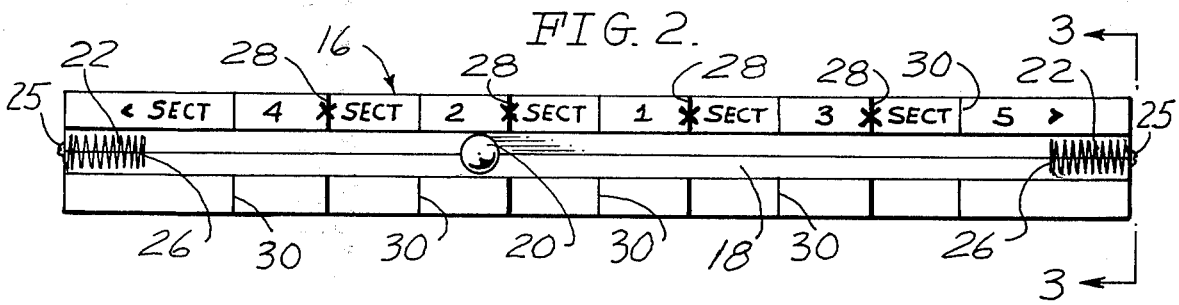
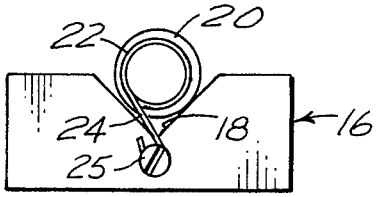
FIG. 3.

RACE GAME APPARATUS

BACKGROUND OF THE INVENTION

This invention relates generally to games of the type having path means for the advancement of playing pieces and means for determining the relative rates of advancement of the playing pieces of different players along said path means. More particularly, the invention relates to such games in which said means for determining the relative rates of advancement of the playing pieces is a function of player skill rather than chance alone.

Various games have been devised in which players in turn advance markers or playing pieces along a course that is laid out on a game board, the course being divided into a series of stations. In some instances the number of stations to which a marker is to be advanced is determined by chance, for example, by rolling dice, no skill being involved in the determination. In other examples, each player spins a pointer that traverses a series of numbers that indicate the number of stations through which a marker is to be advanced. Theoretically, some skill is involved in the spinning of a pointer since the degree to which the pointer is accelerated determines the particular number at which the pointer stops. In practice, however, the resistance to rotation of the pointer is so slight as to preclude any significant development of player skill. For increased player interest it is highly desirable to provide some type of advance-determining means that requires a meaningful degree of player skill as well as the opportunity to increase that skill with practice.

Some games do require substantial skill on the part of a player, and for this purpose the players manipulate means including an electric circuit with numerous contacts to energize selectively a plurality of indicator lamps that represent various values. Unfortunately, electric circuits with numerous contacts are vulnerable to failure and such failure immediately makes the games inoperative.

SUMMARY OF THE INVENTION

A playing board that is a replica of terrain has a tortuous race course that is divided into a series of stations. The different players have distinctively colored playing pieces or markers which may be small plastic representations of contestants in a race. Each player in turn advances his marker from station to station along the course as determined by his skill in imparting motion to a steel ball on a straight guideway that has resilient bumpers at both of its ends. The guideway is divided into five sections which are numbered 1 to 5. The player propels the steel ball along the guideway to cause the ball to recoil from at least one of the two opposite bumpers with the intention of causing the steel ball to come to rest in a designated section of the guideway. Each player takes his turn and must cause the ball to come to rest in guideway section No. 1 before he can advance his marker on the race course. Then in his turn the player must cause the ball to come to rest at section No. 2 of the guideway before he can again advance his marker. The sequence is followed from station No. 1 to station No. 5, and then is repeated.

Each section has two opposite boundary lines and is divided into two parts by a middle line. If the ball stops wholly within the designated section or touching either of the two boundary lines of the designated section, the player advances his marker by one station. If the ball stops at the middle line of the designated section, the player is entitled to advance his marker on the race course by two stations instead of one station. Eventually, one of the players wins the race.

The features and advantages of the invention may be understood from the following detailed description and the accompanying drawing.

BRIEF DESCRIPTION OF THE DRAWING

FIG. 1 is a plan view of a game board having a replica of a race course that is divided into a series of stations;

FIG. 2 is a plan view of a device that each player employs in his turn to determine the number of stations through which his marker is to be advanced along the race course; and FIG. 3 is an end elevation of the device as seen along line 3—3 in FIG. 2.

DESCRIPTION OF THE PREFERRED EMBODIMENT

In FIG. 1, reference numeral 10 generally designates a game board which is a replica of terrain that provides a tortuous race course, the race course being designated by numeral 12. The race course 12 is divided into a sequence of stations which are indicated by a series of transverse lines 14.

The various players have distinctively colored playing pieces or markers 15 which may, for example, represent automotive vehicles. In this instance, each of the markers 15 is a small replica of a motorcycle.

FIGS. 2 and 3 illustrate a device, generally designated 16, which may be employed by each player in his turn to determine the number of stations through which the player's marker is to be advanced along the race course 12. In the present embodiment of the invention, the device 16 is simply a strip of wood or a strip of plastic which is formed on its upper side with a V-shaped groove 18 to serve as a guideway for a heavy metal ball 20. Suitable resilient bumpers 22 which may be coiled compression springs, as shown, are provided at the opposite ends of the guideway to reverse the direction of travel of the ball 20. As indicated in FIG. 3, one end 24 of each of the coiled springs 22 may be partially unwound and anchored to the corresponding end of the device by a screw 25. The other end 26 of each coiled spring 22 is free to permit the traveling ball 20 to compress the spring by impact and thus cause the ball to reverse its direction of travel by recoil.

The guideway 18 of the device 16 may be divided in any suitable manner into sections where the ball 20 may come to rest to determine the number of stations to which the player's marker may be advanced along the race course 12. By way of example, FIG. 2 shows the guideway 18 divided into five sections which are numbered respectively 1 through 5, as shown. Each of the five sections has two opposite boundary lines designated 28 and in addition has a middle line 30 that divides the section into two equal halves.

When each of the players employs the device 16 in his turn, the player manually accelerates the metal ball 20 towards one of the two bumper springs 22. At the player's choice, the acceleration of the steel ball may be relatively light to cause the steel ball to recoil from only one of the spring bumpers 22 before coming to a stop at one of the five sections. By accelerating the steel ball to a greater degree, the steel ball may be caused to recoil from both of the bumper springs in turn and then come to rest at one of the five sections.

FIG. 1 represents an intermediate stage in the course of the simulated race where the markers 15 of four players are strung out at various stations of the race course. Eventually, one of the players wins the race by advancing his marker to the finish line of the course, the finish line being the starting line 32.

The preferred rules for playing the game are as follows:

RULES FOR DETERMINING THE STARTING POSITIONS

In preparation for employing the device 16, a player holds one end of the device to immobilize the device and then manually accelerates the metal ball 20 from either end of the guideway. The ball must have sufficient acceleration to bounce off the particular bumper spring 22 toward which it has been rolled, but the ball may be given sufficient acceleration to recoil from both of the two bumper springs 22 in turn. The player whose ball stops closest to the middle line 30 of the central section No. 1 has the first turn to start the race, and the player whose ball comes to rest at the greatest distance from said middle line has the last turn to start the game.

RULES FOR CARRYING OUT THE RACE

Initially all of the markers 15 are placed at the starting line 32 of the race course, and then each player in turn rolls the ball 20 with the object of causing the ball to stop at a designated one of the five sections of the device. Each player has only one roll per turn.

The first designated section for all of the players is Section No. 1, and a player cannot advance his marker from the starting line until he succeeds in having the ball stop in Section No. 1. Thereafter, the designated section for the player is Section No. 2. In this manner each player progresses through the five sections of the device 16 and then starts over again in section No. 1.

If the ball stops anywhere within the section that is designated for the player or stops at a position where the ball touches either of the boundary lines 28 of the designated section, the player advances his marker one station on the race course 12. If, however, any part of the stopped ball touches the middle line 30 of the section that is designated for the player, the player advances his marker by two stations.

SCORING FOR AN OFFICIAL RACE

An official race comprises three laps of the race course 12. At the end of a lap, the winner is credited with 10 points; second place has a value of 8 points; third place has a value of 6 points; fourth place has a value of 4 points; fifth place has a value of 2 points; and sixth place is awarded 1 point. The player with the highest total of points for the three laps is the winner.

SCORING FOR AN UNOFFICIAL RACE

An unofficial race consists of a single lap, for which points are awarded in the manner described above.

My description in specific detail of the presently preferred embodiment of the invention will suggest various departures from that embodiment within the spirit and scope of the appended claims.

What I claim is:

1. Game apparatus comprising:

a replica of a racecourse having a starting point and a finish point, said course being divided into a sequence of stations;

a plurality of markers representing a plurality of players contesting in a race over said course, said markers being distinguished from each other in appearance to correspond to the different players of the game, and being movable through the sequence of stations; and means operable by each player in turn to determine the number of stations through which the player is to advance his marker along said course;

said determining means comprising:

a guideway divided into sections to determine the advance of a marker from station to station along the racecourse, said guideway comprising an elongate member with a longitudinal groove of V-shaped cross section therein;

a ball freely movable in said longitudinal groove by impetus manually imparted thereto by a player; and metal spring means secured to said elongate member at each end of said longitudinal groove for impact by said ball to reverse the direction of movement of the ball by recoil action.

2. Game apparatus in accordance with claim 1 in which said metal spring means is a spiral spring.

3. Game apparatus in accordance with claim 2 in which the sections into which said guideway is divided are numbered so that a player can be required to first bring said ball to rest in the lowest-numbered section and then consecutively to bring the ball to rest in each higher-numbered section during the playing of a game with said apparatus.

4. Game apparatus in accordance with claim 3 in which said guideway is made of wood.

5. Game apparatus in accordance with claim 4 in which said ball is a heavy metal ball.

* * * * *